US008466761B2

(12) United States Patent
Naka et al.

(10) Patent No.: US 8,466,761 B2
(45) Date of Patent: Jun. 18, 2013

(54) POLARIZED ELECTROMAGNET

(75) Inventors: Yasuhiro Naka, Kounosu (JP); Toshikatsu Ohgami, Kumagaya (JP); Koji Okubo, Kumagaya (JP); Kouetsu Takaya, Kounsou (JP); Kenji Suzuki, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/138,303

(22) PCT Filed: Jun. 14, 2010

(86) PCT No.: PCT/JP2010/003932

§ 371 (c)(1), (2), (4) Date: Oct. 7, 2011

(87) PCT Pub. No.: WO2011/021330

PCT Pub. Date: Feb. 24, 2011

(65) Prior Publication Data

US 2012/0161908 A1 Jun. 28, 2012

(30) Foreign Application Priority Data

Aug. 20, 2009 (JP) ..... 2009-190582

(51) Int. Cl.
*H01H 51/22* (2006.01)

(52) U.S. Cl.
USPC ..... 335/78; 335/132

(58) Field of Classification Search
USPC ..... 335/78
See application file for complete search history.

(56) References Cited

U.S. PATENT DOCUMENTS

| | | | | |
|---|---|---|---|---|
| 4,509,026 | A * | 4/1985 | Matsushita | 335/85 |
| 5,945,900 | A * | 8/1999 | Shibata et al. | 335/234 |
| 2012/0133462 | A1 * | 5/2012 | Naka et al. | 335/188 |

FOREIGN PATENT DOCUMENTS

| | | |
|---|---|---|
| JP | H01-315920 | 12/1989 |
| JP | H02-091901 | 3/1990 |
| JP | H03-049125 | 3/1991 |
| JP | U H05-73838 | 10/1993 |

* cited by examiner

*Primary Examiner* — Elvin G Enad
*Assistant Examiner* — Lisa Homza
(74) *Attorney, Agent, or Firm* — Manabu Kanesaka

(57) ABSTRACT

A polarized electromagnet has a spool around which an exciting coil is wound; a movable plunger penetrating the spool; an interior yoke fixed on an outer side of the spool; an exterior yoke disposed to maintain a predetermined interval on an outer side of the interior yoke; and a permanent magnet disposed between the interior yoke and exterior yoke. The exterior yoke has a pair of end plate portions opposing two ends of the spool, and a linking plate portion linking the pair of end plate portions. The interior yoke has a first opposing plate portion opposing the linking plate portion of the exterior yoke, and second opposing plate portions opposing one end plate portion of the exterior yoke, and the first opposing plate portion and the second opposing plate portion are linked without coming close to the exterior yoke.

6 Claims, 9 Drawing Sheets

POLARIZED ELECTROMAGNET

RELATED APPLICATIONS

The present application is National Phase of International Application No. PCT/JP2010/003932 filed Jun. 14, 2010, and claims priority from, Japanese Application No. 2009-190582 filed Aug. 20, 2009, the disclosure of which is hereby incorporated by reference herein in its entirety.

TECHNICAL FIELD

The present invention relates to a polarized electromagnet including a spool around which an electromagnetic coil is wound, a movable plunger penetrating the spool, an interior yoke fixed on the outer side of the spool, an exterior yoke disposed to maintain a predetermined interval on the outer side of the interior yoke, and a permanent magnet disposed between the interior yoke and exterior yoke.

BACKGROUND ART

As this kind of polarized electromagnet, an operating electromagnet is linked to a contact mechanism of an electromagnetic contactor, or the like, and contact portions are driven to open and close by the suctioning action of the electromagnet. With regard to the operating electromagnet, one is known wherein a polarized electromagnet is employed in order to cause the electromagnet to be stably held in a pole open position in a non-excited condition (for example, refer to Patent Document 1).

As there is a demand for downsizing this kind of polarized magnet, it has heretofore had a spool 102 indicated by the dash-dotted line in FIG. 15, around which is wound an exciting coil 100, and through which is inserted a plunger 101, as shown in FIGS. 15 to 18. There has been a proposal of a polarized electromagnet that has a configuration wherein an interior yoke 104 is inserted and fixed in a flange portion 103 of the spool 102, an exterior yoke 105 is disposed for a predetermined distance to the outer side of the interior yoke 104, and a permanent magnet 106 is disposed between the interior yoke 104 and exterior yoke 105. Herein, the interior yoke 104 is formed in an approximate L-shape of a flat plate portion 104*a* along the central axis of the spool 102, an inclined plate portion 104*b* that extends at an inclination diagonally inward from the leading end of the flat plate portion 104*a*, and an extending plate portion 104*c* that extends inward from the leading end of the inclined plate portion 104*b* in a direction perpendicular to the central axis of the spool 102. Also, the exterior yoke 105 has a flat plate portion 105*a*, an inclined plate portion 105*b*, and an extending portion 105*c*, respectively opposing the flat plate portion 104*a*, inclined plate portion 104*b*, and extending plate portion 104*c* of the interior yoke 104, maintaining a predetermined distance on the outer side. Also, the exterior yoke 105 has a bent portion 105*d* bent inward from the other end side of the flat plate portion 105*a*, and is formed in a C shape seen from above of the flat plate portion 105*a*, inclined plate portion 105*b*, extending portion 105*c*, and bent portion 105*d*. Furthermore, armatures 107 and 108 are fixed and held at the left and right ends of the plunger 101. Herein, the armature 107 is disposed between the interior yoke 104 and exterior yoke 105, and the armature 108 is disposed on the outer side of the exterior yoke 105.

An operation of the polarized electromagnet having the heretofore described configuration is such that, in a condition in which the exciting coil 100 is in a non-excited condition, the plunger 101 is biased to the pole open position by an unshown return spring, and the armature 107 is held in a condition in which it is suctioned to the extending plate portion 104*c* of the interior yoke 104, as shown in FIG. 15.

From this condition, if the exciting coil 100 is energized and excited to a polarity reverse to that of the permanent magnet 106, a suction force acts between the left and right armatures 107 and 108 of the plunger 101 and the exterior yoke 105. At the same time, a repulsion force acts between the left side armature 107 and the interior yoke 104. Because of this, the plunger 101 moves to the left against the spring force of the return spring, and the armatures 107 and 108 are adsorbed to the exterior yoke 105.

Related Art Documents

Patent Documents

Patent Document 1: JP-A-1-315920

DISCLOSURE OF THE INVENTION

Problems that the Invention is to Solve

However, with the heretofore known example that pursues downsizing illustrated in FIGS. 15 to 18, there is an unsolved problem in that, as the inclined plate portion 104*b* of the interior yoke 104 and the inclined plate portion 105*b* of the exterior yoke 105 are close together, a magnetic flux flows between the inclined plate portions 104*b* and 105*b*, which do not affect the suction force, a magnetic flux leakage occurs, and the suction force of the permanent magnet 106 decreases.

Therefore, the invention, having been contrived bearing in mind the unsolved problems of the heretofore known example, has an object of providing a polarized electromagnet that, without changing the external form, can suppress magnetic flux leakage in a position that does not affect the suction force between the interior yoke and exterior yoke, and increase the suction force of the permanent magnet.

Means for Solving the Problems

In order to achieve the heretofore described object, a polarized electromagnet according to one aspect of the invention includes a spool around which an exciting coil is wound, a movable plunger penetrating the spool, an interior yoke fixed on the outer side of the spool, an exterior yoke disposed to maintain a predetermined interval on the outer side of the interior yoke, and a permanent magnet disposed between the interior yoke and exterior yoke. Then, the exterior yoke is formed of a pair of end plate portions opposing either end of the spool, and a linking plate portion linking the pair of endplate portions. Also, the interior yoke has a first opposing plate portion opposing the linking plate portion of the exterior yoke, and second opposing plate portions opposing one end plate portion of the exterior yoke, and the first opposing plate portion and second opposing plate portions are linked without coming close to the exterior yoke.

According to this configuration, portions in the interior yoke actually opposing the exterior yoke are only the end plate portion of the exterior yoke and the second opposing portions of the interior yoke, which affect suction force, and it is possible to prevent leakage magnetic flux, and increase the suction force.

Also, the polarized electromagnet according to another aspect of the invention is such that the interior yoke is of a configuration wherein the first opposing plate portion and second opposing plate portions are linked by an upper and lower pair of bent portions wherein the upper and lower end portions of the first opposing plate portion are bent to the exciting coil side.

Consequently, the interior yoke is formed in a cross-sectional channel form formed of the bent portions joined to the end portions of the first opposing plate portion parallel to the central axis of the spool, forming the second opposing plate portions that oppose one of the end plate portions of the exterior yoke, bent on the leading end side protruding beyond the first opposing plate portion at the leading ends of the bent portions, which do not oppose the exterior yoke.

According to this configuration, it is possible to link the first opposing plate portion and second opposing plate portions of the interior yoke with the bent portions, utilizing the dead space at the four corners of the exciting coil, and it is possible to reliably prevent the occurrence of leakage magnetic flux without increasing the size of the configuration of the interior yoke.

Also, the polarized electromagnet according to another aspect of the invention is such that the permanent magnet is disposed between the linking plate portion of the exterior yoke and the first opposing plate portion of the interior yoke.

According to this configuration, it is possible to dispose a comparatively large permanent magnet and generate a larger suction force.

Also, in the polarized electromagnet according to another aspect of the invention, the interior yoke is such that the second opposing plate portions are inserted and fixed in an insertion and holding portion formed on the spool.

According to this configuration, it is possible to easily carry out the fixing of the interior yoke on the spool simply by inserting the second opposing plate portions of the interior yoke in the insertion and holding portion.

Also, in the polarized electromagnet according to another aspect of the invention, the size of the space between the outer sides of the bent portions is set to be equal to or less than the diameter of the exciting coil.

According to this configuration, as the bent portions do not protrude to the outer side of the exciting coil, it is possible to ensure a wide flux path to the second opposing plate portions without changing the external dimensions.

Also, the polarized electromagnet according to another aspect of the invention is such that the spool is configured of a non-magnetic body, and forms rectangular flange portions sandwiching the two ends of the exciting coil at either end of a cylindrical portion through which the plunger is inserted. Then, a coil retainer plate portion that makes contact with one end portion of the exciting coil is formed on, of the flange portions, the flange portion in which the interior yoke is inserted and held. By forming a frame-like armature housing portion attached integrally to the coil retainer plate portion in a central portion on each side thereof, an insertion portion inserted in the second opposing plate portions of the interior yoke is formed between the retainer plate portion and the armature housing. Furthermore, a projection for positioning the armature is provided in a position opposing the armature of the armature housing portion.

By adopting this configuration, by forming the coil retainer plate portion and armature housing portion separately in the flange portion in which the interior yoke is inserted and held, even in the event that the coil retainer plate portion is distorted when the exciting coil is wound, the effect thereof does not affect the armature housing portion. Also, by forming the armature positioning projection in the armature housing portion, it is possible to house the armature without interposing a separate non-magnetic body plate or non-magnetic plate.

Advantage of the Invention

According to the invention, if the opposing portions between the interior yoke and exterior yoke linked by the permanent magnet are not brought close together in a position that does not affect the suction force, an advantage is obtained in that it is possible to reliably prevent leakage magnetic flux in a position that does not affect the suction force between the interior yoke and exterior yoke, and to increase the suction force of the permanent magnet.

MODE FOR CARRYING OUT THE INVENTION

Hereafter, a description will be given, based on the drawings, of an embodiment of the invention.

Figure 1:
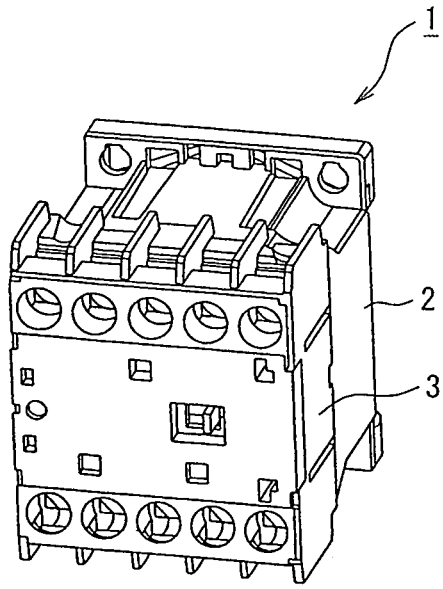
FIG. 1 is a perspective view showing one embodiment when applying the invention to an electromagnetic contactor.
Figure 2:
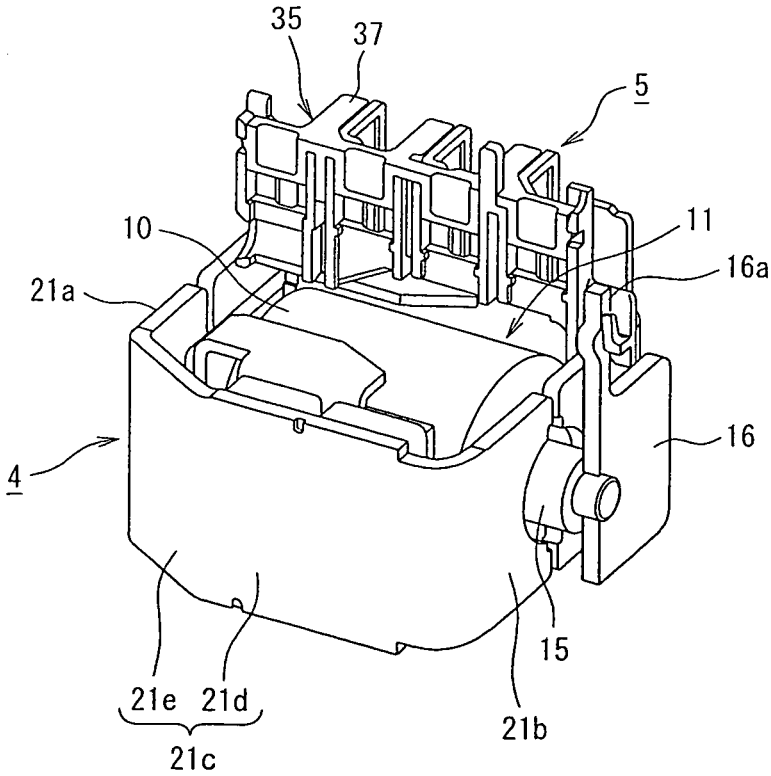
FIG. 2 is a perspective view showing a cross-section of a contact mechanism installed inside the electromagnetic contactor, and a polarized electromagnet that causes the contact mechanism to slide.

In FIG. 1, numeral 1 is an electromagnetic contactor, and the electromagnetic contactor 1 has a lower case 2 and an upper case 3, each of which is formed of a synthetic resin material having insulation. A polarized electromagnet 4 is installed inside the lower case 2, as shown in FIG. 3, and a contact mechanism 5 shown in FIG. 2 is installed inside the upper case 3.

Figure 3:
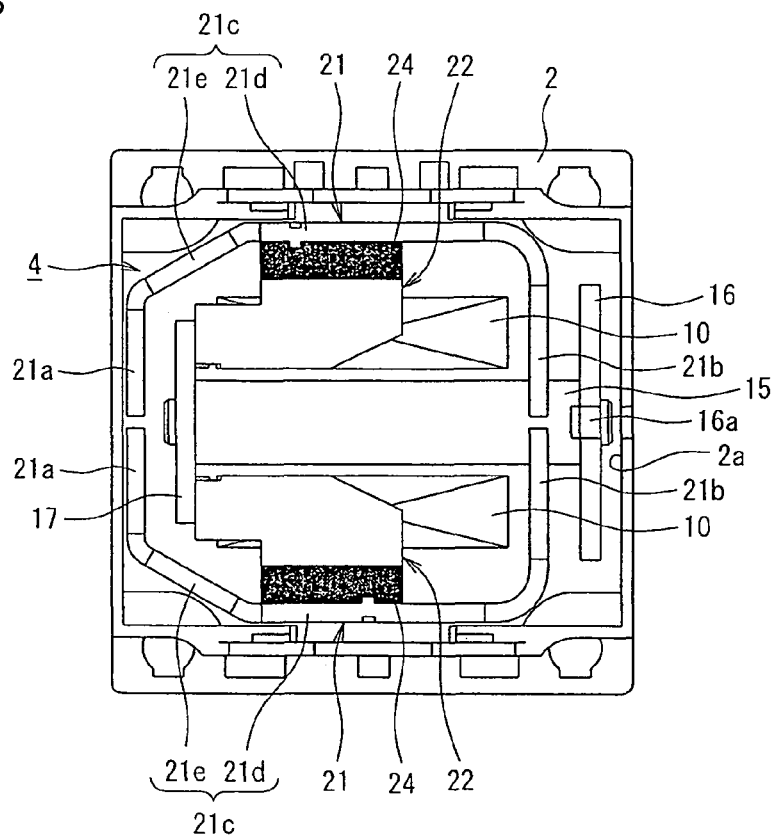
FIG. 3 is a schematic plan view of a lower case housing the polarized electromagnet.
Figure 4:
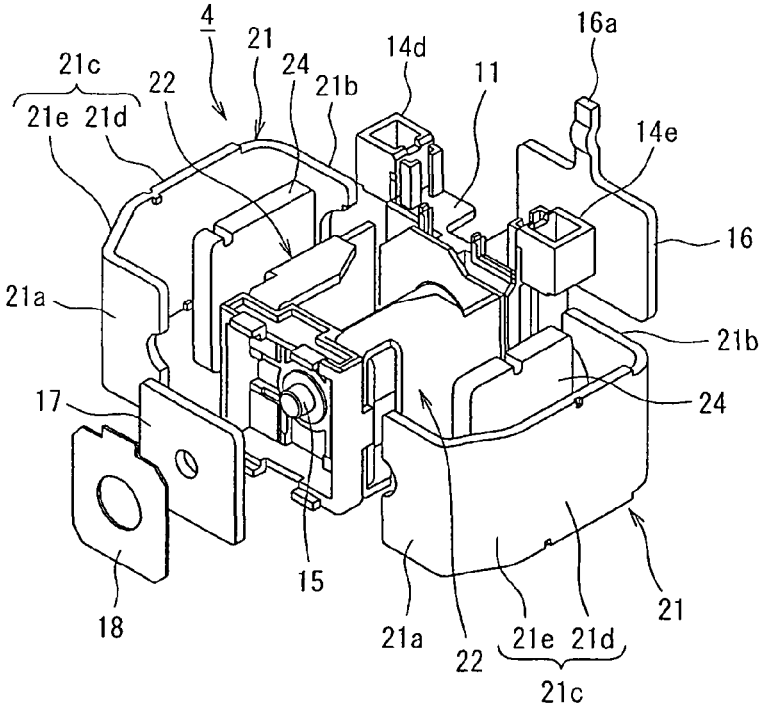
FIG. 4 is an exploded perspective view of the polarized electromagnet.
Figure 5:
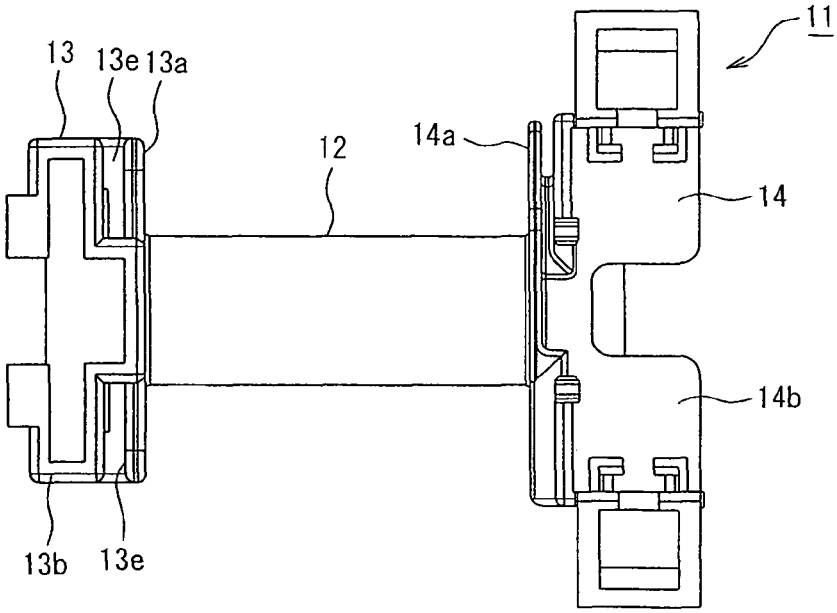
FIG. 5 is a plan view showing a spool.
Figure 6:
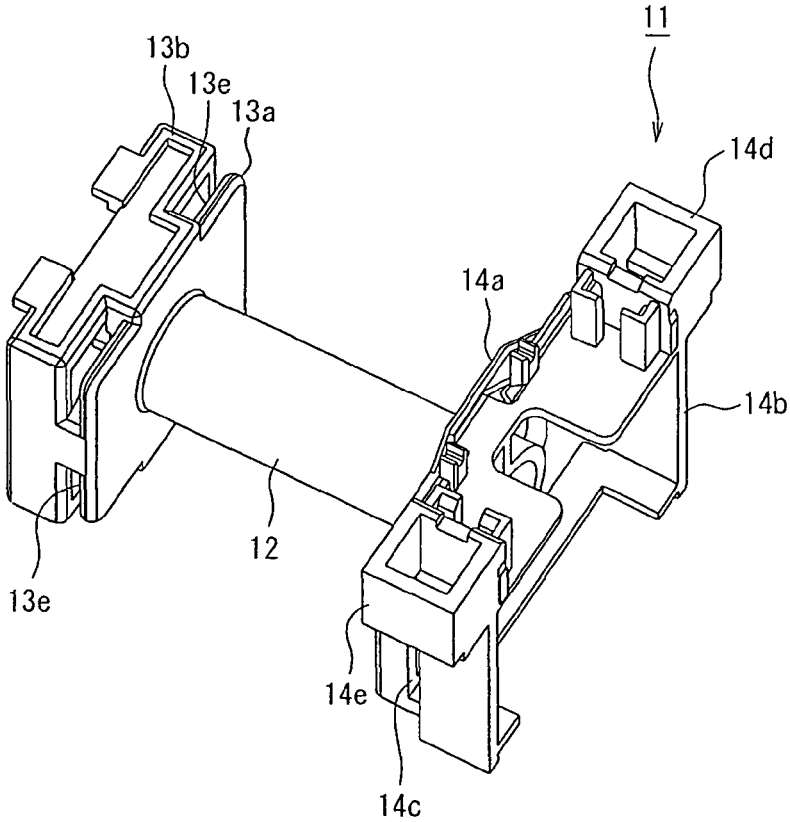
FIG. 6 is a perspective view of the spool seen from an upper right direction.

The polarized electromagnet 4, as shown in FIGS. 3 and 4, has a spool 11 around which is wound an exciting coil 10 configuring an electromagnet. The spool 11, as shown in FIG.

Figure 7:
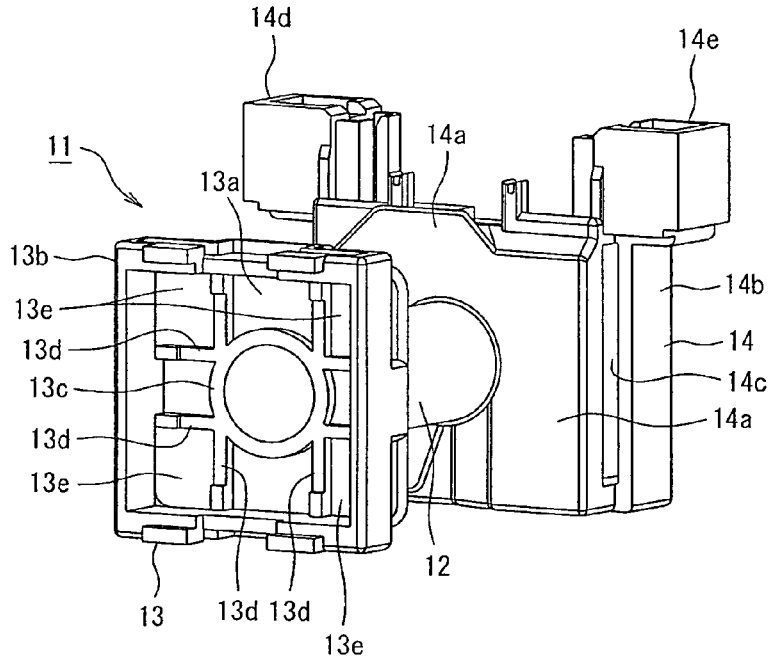
FIG. 7 is a perspective view of the spool seen from a left side direction.
Figure 8:
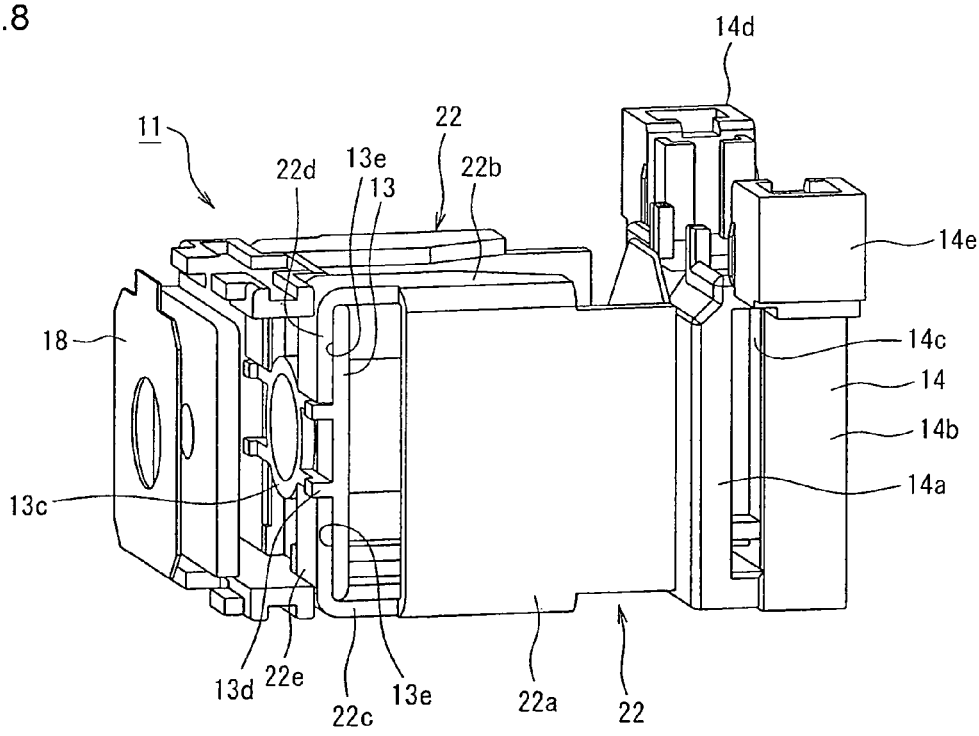
FIG. 8 is a perspective view showing a left end side of the polarized electromagnet.

5 to FIG. 8, is configured of a cylindrical portion 12, and left and right flange portions 13 and 14 formed integrally at either end of the cylindrical portion 12. The left flange portion 13 is configured of a rectangular coil retainer plate portion 13*a* that restricts an end portion of the exciting coil 10, and a rectangular frame-like armature housing portion 13*b* attached to the outer side of the coil retainer plate portion 13*a* in a central position on each side. A ring-like projection 13*c* as a projection for positioning with respect to the cylindrical portion 12, and a lattice-form projection 13*d* extending outward from the ring-like projection 13*c*, are formed protruding on the outer surface of the coil retainer plate 13*a*, as shown in FIG. 7. Herein, yoke holding portions 13*e* in which are inserted and held second opposing plate portions 22*d* and 22*e* of interior yokes 22, to be described hereafter, are formed in the four corners partitioned off by the lattice-form projection 13*d*.

The right flange portion 14 has a rectangular coil retainer plate portion 14*a* that restricts an end portion of the exciting coil 10, and a rectangular frame-like armature housing portion 14*b* attached to the outer side of the coil retainer plate portion 14*a* by the outer peripheral portion side thereof. Yoke holding portions 14*c* in which are inserted and held end plate portions 21*a* of exterior yokes 21, to be described hereafter, and coil terminal portions 14*d* and 14*e* in which are tied to coil start and coil finish end portions of the exciting coil 10, are formed on the armature housing portion 14*b*.

Figure 11:
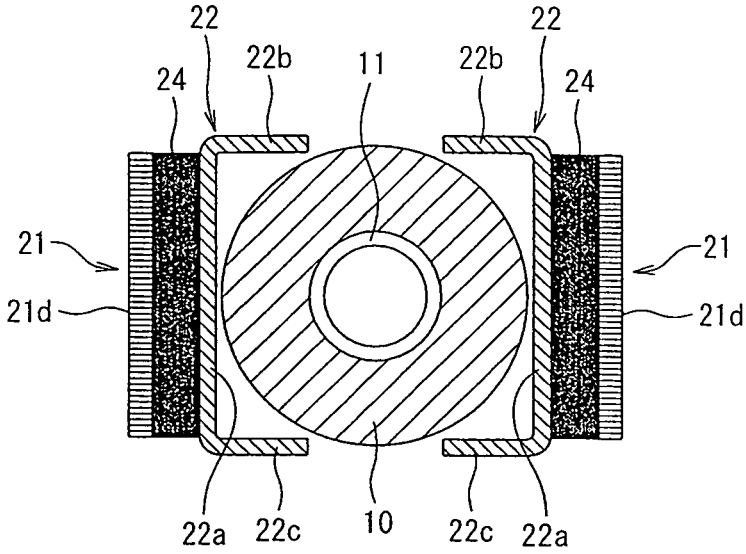
FIG. 11 is a cross-sectional view in a direction perpendicular to the axial direction of the polarized electromagnet.

Then, the exciting coil 10 is installed wound between the cylindrical portion 12 of the spool 11 and the coil retainer plate portions 13*a* and 14*a* of the left and right flange portions 13 and 14, as shown in FIGS. 3 and 11.

Also, a plunger 15 penetrates, and is movably held inside, the cylindrical portion 12 of the spool 11. A first armature 16 is fixed in the corresponding end portion inside the armature housing portion 14*b* formed in the right flange portion 14 of the spool 11 at the right end of the plunger 15. Also, a second armature 17 is fixed in the corresponding position inside the armature housing portion 13*b* formed in the left flange portion 13 of the spool at the left end of the plunger 15, and a non-magnetic plate 18 is disposed on the outer side of the second armature 17. Then, a drive lever 16*a* linked to a movable contact support 37 of a movable contact portion 35 of the contact mechanism 5, which drives the movable contact support 37 in left and right directions, is disposed on the upper surface of the first armature 16, as shown in FIGS. 2 and 4.

Furthermore, an axisymmetrical front and back pair of exterior yokes 21 sandwiching the spool 11, guided into and fixed inside a housing portion 2*a* formed in the lower case 2, are disposed in the right flange portion 14 of the spool 11. Also, an axisymmetrical front and back pair of interior yokes 22 sandwiching the spool 11, maintaining a predetermined distance from the exterior yokes 21, are disposed in the left flange portion 13 of the spool 11.

Figure 10:
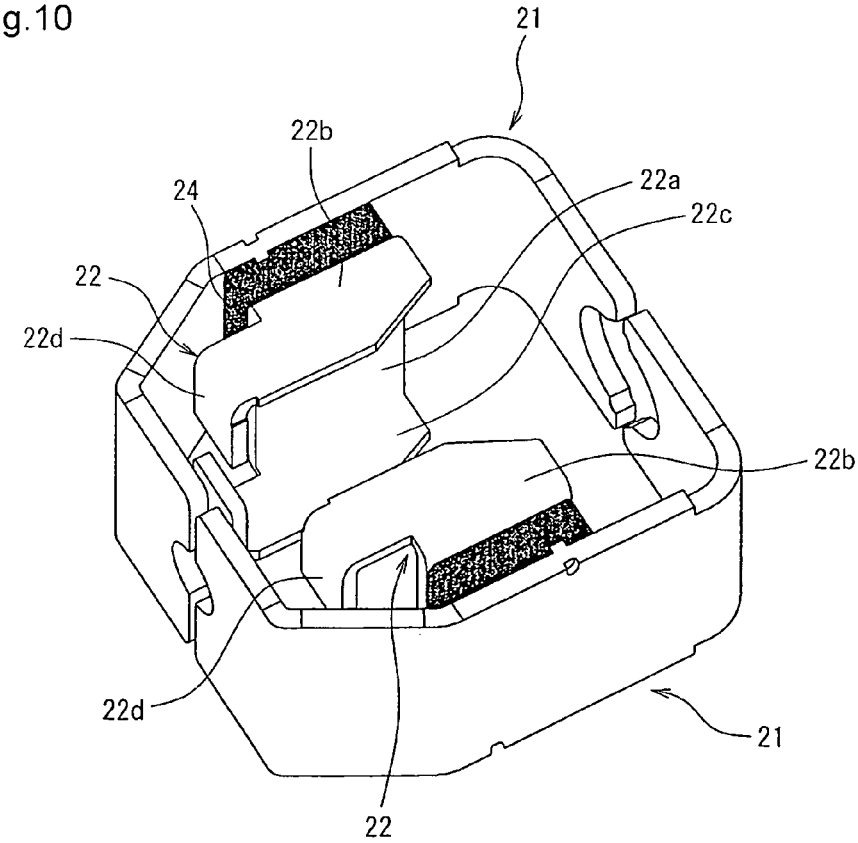
FIG. 10 is a perspective view showing the polarized electromagnet in a condition in which the spool is removed.

The exterior yoke 21, as is particularly clear in FIGS. 3, 4, and 10, is formed in an approximately C-channel form seen from above of a left end plate portion 21*a* opposing the left flange portion 13 of the spool 11 and distanced therefrom by a predetermined interval, a right end plate portion 21*b* inserted in the right flange portion 14 of the spool 11, and a linking plate portion 21*c* that links the left and right end plate portions 21*a* and 21*b*. The linking plate portion 21*c* is formed of a flat plate portion 21*d* that links with the right end plate portion 21*b*, extending in the tangential direction of the exciting coil wound around the spool 11, and an inclined plate portion 21*e* formed on the opposite side of the flat plate portion 21*d* to the right end plate portion 21*b* that inclines inward as it goes to the left end, and the left end plate portion 21*a* is linked to the left end portion of the inclined plate portion 21*e*.

Figure 12:
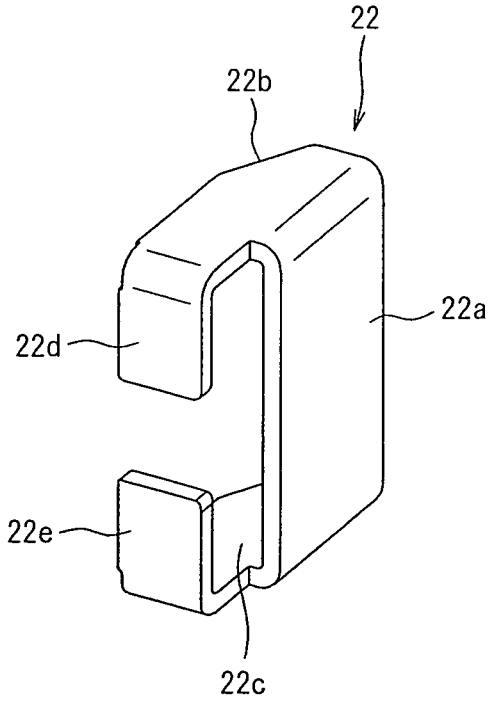
FIG. 12 is a perspective view showing the interior yoke.

Meanwhile, the interior yoke 22, as is particularly clear in FIGS. 11 and 12, has a first opposing plate portion 22*a* that opposes the flat plate portion 21*d* of the exterior yoke 21, and bent portions 22*b* and 22*c* extending inward and joined to upper and lower end portions of the first opposing plate portion 22*a* in the tangential direction of the exciting coil 10 wound around the spool 11. Then, second opposing plate portions 22*d* and 22*e* formed bent inwardly are formed on the leading end side protruding beyond the first opposing plate portion 22*a* at the leading ends of the bent portions 22*b* and 22*c*. Then, the second opposing plate portions 22*d* and 22*e* of the interior yoke 22 are inserted in and held by the yoke holding portions 13*e* of the left flange portion 13 of the spool 11, and are opposed by the left end plate portion 21*a* of the exterior yoke 21.

Also, the first armature 16 is disposed on the outer side of the right end plate portion 21*b* of the exterior yoke 21, and the second armature 17 is disposed between the left end plate portion 21*a* of the exterior yoke 21 and the second opposing plate portions 22*d* and 22*e* of the interior yoke 22.

Furthermore, a permanent magnet 24 is disposed between the flat plate portion 21*d* of the exterior yoke 21 and the first opposing plate portion 22*a* of the interior yoke 22.

Figure 13:
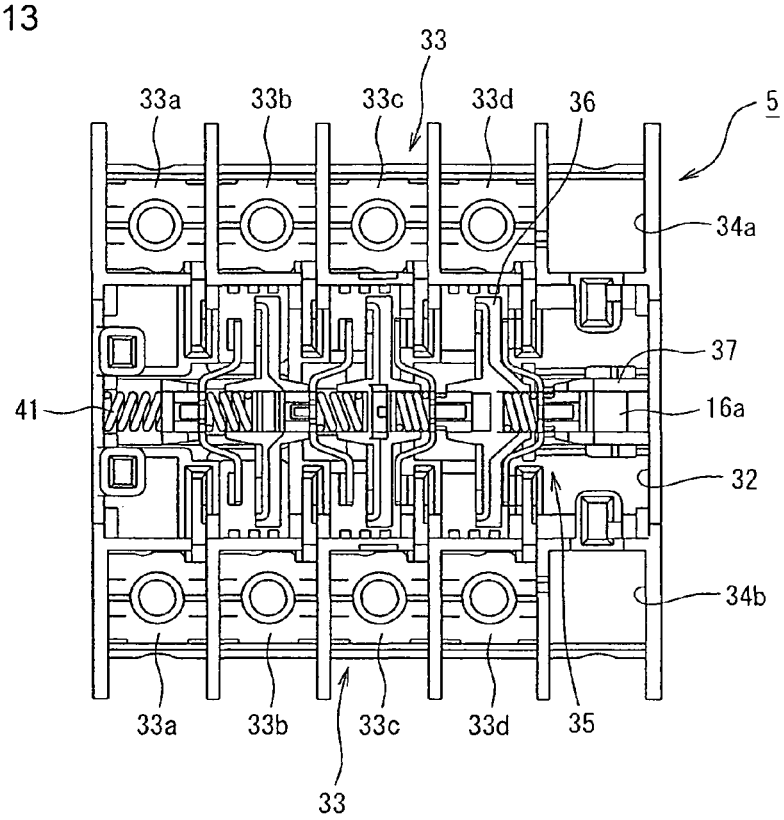
FIG. 13 is a plan view showing the contact mechanism.
Figure 14:
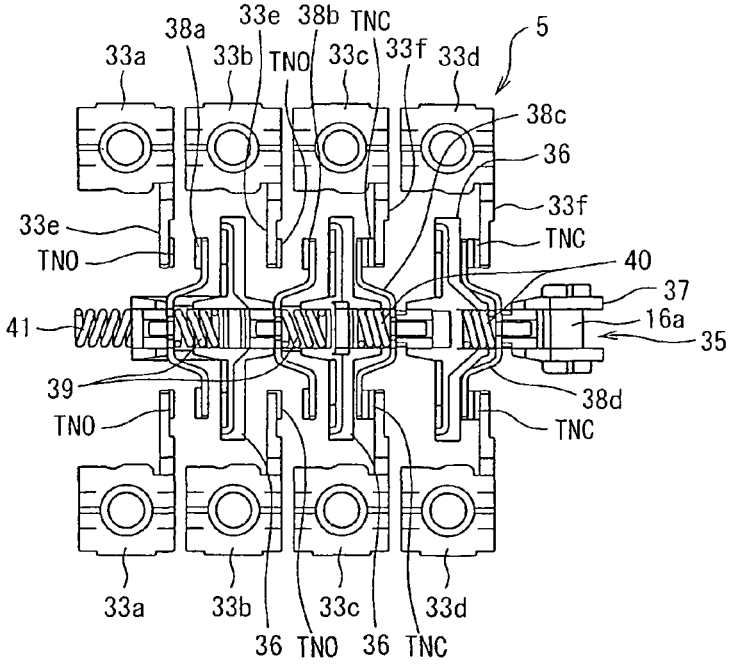
FIG. 14 is a plan view showing a movable contact portion of the contact mechanism.

The contact mechanism 5, as shown in FIGS. 13 and 14, includes a movable contact housing portion 32 extending in the left-right direction formed in a central portion in the front-back direction of the upper case 3, main circuit terminal portions 33 disposed symmetrically front and back sandwiching the movable contact housing portion 32, and terminal insertion portions 34*a* and 34*b* in which are inserted and hold the coil terminal portions 14*d* and 14*e* of the polarized electromagnet 4.

Each of the main circuit terminal portions 33 has main circuit terminals 33*a* to 33*d*, as shown in FIG. 14, each of the main circuit terminals 33*a* and 33*b* has a contact piece 33*e* protruding inward into the movable contact housing portion 32 from the interior right end side, and a fixed contact TNO is formed on the leading end right side surface of the contact piece 33*e*. Also, each of the main circuit terminals 33*c* and 33*d* has a contact piece 33*f* protruding inward into the movable contact housing portion 32 from the interior right end, and a fixed contact TNC is formed on the leading end left side surface of the contact piece 33*f*.

Then, the movable contact portion 35 is disposed so as to be slidable in the left-right direction in the movable contact housing portion 32. The movable contact portion 35 has the movable contact support 37 made of a synthetic resin material in which partition walls 36 maintaining predetermined intervals are formed, and movable contacts 38*a* to 38*d* supported by the partition walls 36 of the movable contact support 37. Herein, the movable contacts 38*a* and 38*b* oppose the fixed contacts TNO of the main circuit terminals 33*a* and 33*b* respectively, and are biased by contact springs 39 in a direction away from the partition walls 36 to the left. Also, the movable contacts 38*c* and 38*d* oppose the fixed contacts TNC of the main circuit terminals 33*c* and 33*d* respectively, and are biased by contact springs 40 in a direction away from the partition walls 36 to the right.

Then, the movable contact support 37 is biased to the right by a return spring 41 disposed on the left, and the drive lever 16*a* formed on the first armature 16 of the polarized electromagnet 4 is linked to the right end of the movable contact support 37.

Next, a description will be given of actions of the heretofore described embodiment.

Now, in a condition in which the coil terminal portions 14*d* and 14*e* are not energized, the exciting coil 10 is in a non-excited condition, and no drive force to drive the plunger 15 is generated, but in the contact mechanism 5, the movable contact support 37 is biased to the right by the return spring 41. Meanwhile, with the polarized electromagnet 4, by the magnetic force of the permanent magnet 24 being transmitted to the second opposing plate portions 22*d* and 22*e* via the interior yoke 22, the second armature 17 is suctioned by the second opposing plate portions 22*d* and 22*e*. Because of this, as well as the movable contacts 38*a* and 38*b* being brought to the pole open position and detached from the fixed contacts TNO of the main circuit terminals 33*a* and 33*b*, the movable contacts 38*c* and 38*d* are pressed into contact with the fixed contacts TNC of the main circuit terminals 33*c* and 33*d* by the contact springs 40.

From the condition in which the movable contact portion 35 of the contact mechanism 5 is in the pole open position, the exciting coil 10 is excited to a polarity the reverse that of the permanent magnet 24 by energizing the coil terminal portions 14*d* and 14*e*. Because of this, a suction force acts between the left and right armatures 17 and 16 and the left and right end plate portions 21*a* and 21*b* of the exterior yoke 21. At the same time, a repulsion force acts between the left side armature 17 and the second opposing plate portions 22*d* and 22*e* of the interior yoke 22. Because of this, the plunger 15 moves to the left against the spring force of the return spring 41, and the armatures 17 and 16 are adsorbed to the end plate portions 21*a* and 21*b* of the exterior yoke 21. Because of this, the movable contact support 37 of the movable contact portion 35 moves to the left against the return spring 41 via the drive lever 16*a* of the first armature 16, and attains a pole closed position at which the movable contacts 38*a* and 38*b* contact with the fixed contacts TNO of the main circuit terminals 33*a* and 33*b* with the pressing force of the contact springs 39. By the movable contact support 37 moving to the left, the movable contacts 38*c* and 38*d* withdraw from the fixed contacts TNC of the main circuit terminals 33*c* and 33*d*.

In this way, when the energization of the coil terminal portions 14*d* and 14*e* is stopped in the condition in which the contact mechanism 5 is in the pole closed position, the exciting coil 10 returns to the non-excited condition, the second armature 17 is suctioned by the pressing force of the return spring 41 and the suction force of the second opposing plate portions 22*d* and 22*e* of the interior yoke 22 caused by the permanent magnet 24, and the movable contact support 37 of the movable contact portion 35 returns to the heretofore described pole open position.

At this time, with the polarized electromagnet 4, a magnetic flux from the permanent magnet 24 is such that, supposing for example that the interior yoke 22 side is the N pole and the exterior yoke 21 side the S pole, a flux path is formed wherein a magnetic flux emitted from the N pole reaches the second opposing plate portions 22*d* and 22*e*, via the bent portions 22*b* and 22*c*, from the first opposing plate portion 22*a* of the interior yoke 22, passes from the second opposing plate portions 22*d* and 22*e* through the end plate portion 21*b*, inclined plate portion 21*e*, and flat plate portion 21*d* of the exterior yoke 21, and reaches the S pole of the permanent magnet 24.

Figure 15:
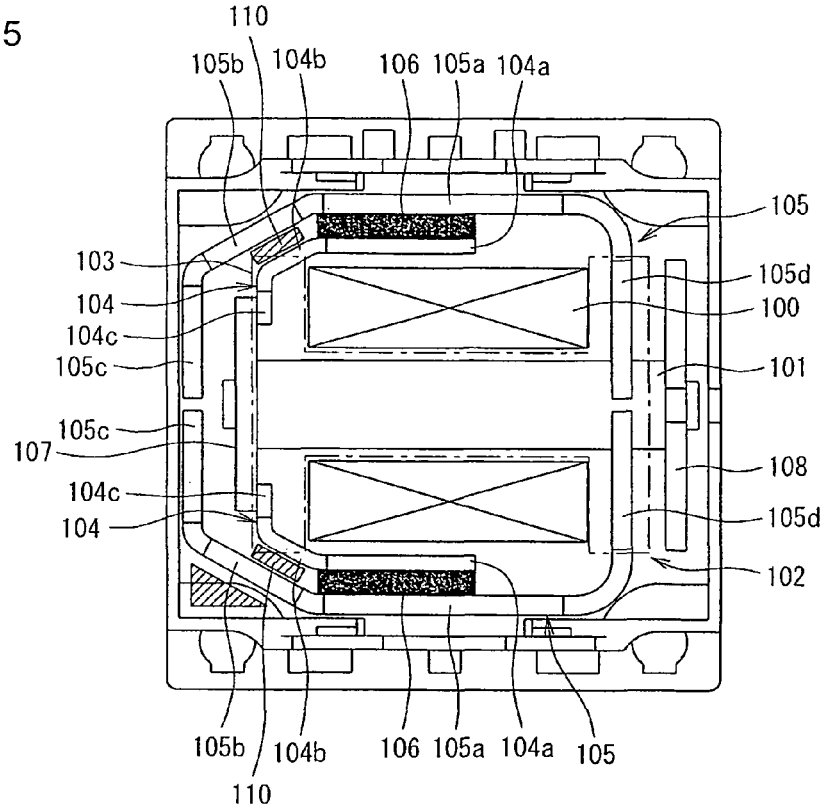
FIG. 15 is a plan view showing a heretofore known polarized electromagnet.
Figure 16:
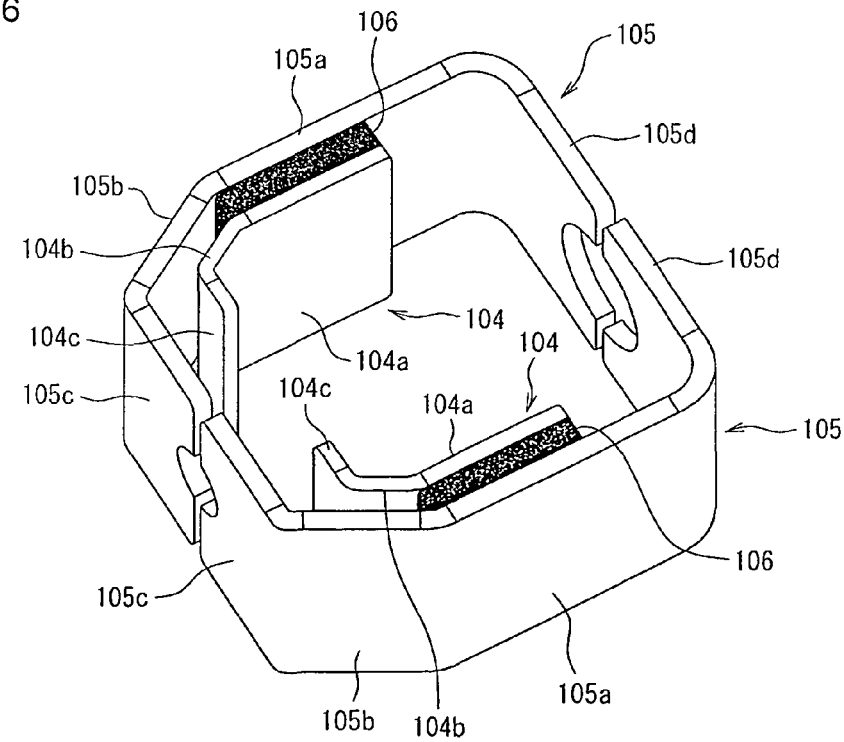
FIG. 16 is a perspective view showing the heretofore known polarized electromagnet with the spool removed.
Figure 17:
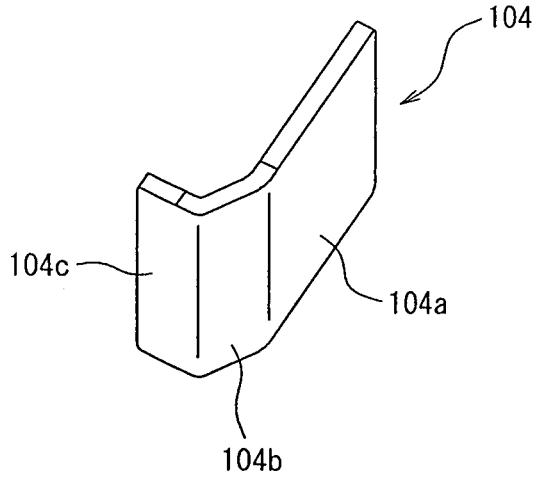
FIG. 17 is a perspective view showing a heretofore known interior yoke.

At this time, as shown in FIG. 3, there is hardly any place in which the exterior yoke 21 and interior yoke 22 approach and oppose each other, and the left end plate portion 21*a* of the exterior yoke 21 and second opposing plate portions 22*d* and 22*e* of the interior yoke 22, which need suction force, approach and oppose each other. For this reason, as it does not happen that a magnetic flux leakage portion 110 is formed by an inclined plate portion 104*b* of an interior yoke 104 and an inclined plate portion 105*b* of an exterior yoke 105 approaching and opposing each other, as in the heretofore known example shown in the heretofore described FIG. 15, it is possible to reduce the leakage magnetic flux, and increase the suction force at the second opposing plate portions 22*d* and 22*e* of the interior yoke 22.

Figure 18:
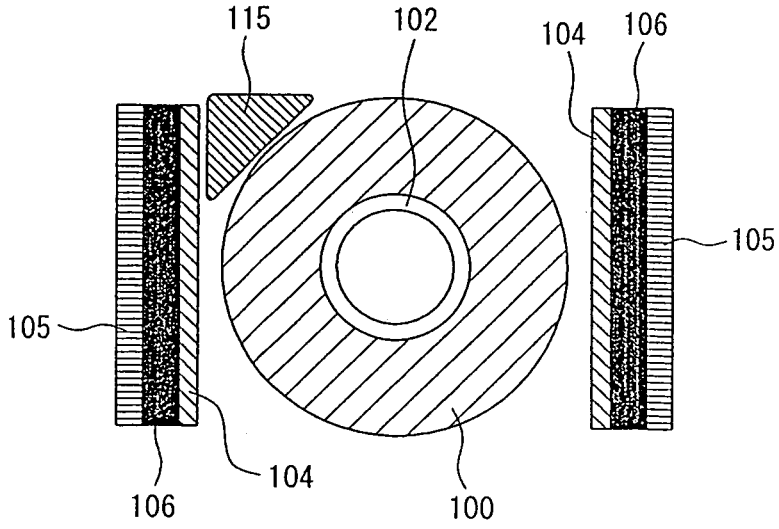
FIG. 18 is a cross-sectional view in a direction perpendicular to the axial direction of the heretofore known polarized electromagnet.

Moreover, as the second opposing plate portions 22*d* and 22*e* of the interior yoke 22 are linked to the first opposing plate portion 22*a*, which makes contact with the permanent magnet 24, via the bent portions 22*b* and 22*c*, it is possible to dispose the bent portions 22*b* and 22*c* utilizing a dead space 115 at the four corners on the outer peripheral side of the cylindrical exciting coil 10 shown in FIG. 18 of the previously mentioned heretofore known example, as shown in FIG. 11, meaning that it is possible to leave the external form of the interior yoke 22 as it is in the heretofore known example, and it is possible to avoid increasing the whole size of the configuration.

Figure 9:
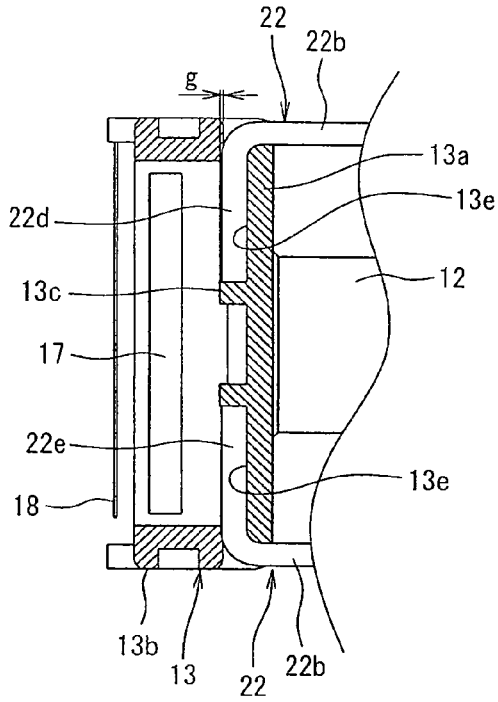
FIG. 9 is an enlarged sectional view showing a condition in which an interior yoke is attached to the spool.

Also, in the embodiment, the spool 11, as shown in FIG. 4 to FIG. 9, is such that the left and right flange portions 13 and 14 formed at either end portion of the cylindrical portion 12 are configured respectively of the coil retainer plate portions 13*a* and 14*a*, and the armature housing portions 13*b* and 14*b* distanced a predetermined distance to the outer side from the coil retainer plate portions 13*a* and 14*a*. Then, the ring-like projection 13*c*, and the lattice-form projection 13*d* extending outward from the ring-like projection 13*c*, are formed on the outer surface of the coil retainer plate portion 13*a*. Because of this, it is possible to ensure the rigidity of the coil retainer plate portion 13*a* with the ring-like projection 13*c* and lattice-form projection 13*d*. Moreover, by making the projection height of the ring-like projection 13*c* or lattice-form projection 13*d* greater than the thickness of the second opposing plate portions 22*d* and 22*e* of the interior yoke 22, a gap g of a predetermined length is formed between the ring-like projection 13*c* or lattice-form projection 13*d* and the outer surface of the second opposing plate portions 22*d* and 22*e*, as shown in FIG. 9. Because of this, when the second armature 17 is suctioned by the second opposing plate portions 22*d* and 22*e*, the second armature comes into contact with the ring-like projection 13*c* or lattice-form projection 13*d*, and opposes the second opposing plate portions 22*d* and 22*e*, maintaining the predetermined gap g, without making direct contact with the second opposing plate portions 22*d* and 22*e*. Consequently, as it is not necessary to insert a non-magnetic plate for preventing the second armature 17 and second opposing plate portions 22*d* and 22*e* coming into direct contact, it is possible to reduce the number of parts by this amount.

In the heretofore described embodiment, a description is given of a case in which the exterior yoke 21 is such that the linking plate portion 21*c* linking the left and right end plate portions 21*a* and 21*b* is configured of the flat plate portion 21*d* and inclined plate portion 21*e*. However, it is not limited to this, even in a case of the inclined plate portion 21*e* being omitted and configured with the left and right endplate portions 21*a* and 21*b* and flat plate portion 21*d*. The formation of a magnetic flux leakage portion may be prevented by adopting the configuration shown in FIG. 12 for the interior yoke 22, and a close portion is formed in a position other than one in which suction force is caused to act between the interior yoke 22 and the exterior yoke 21.

Also, in the heretofore described embodiment, a description is given of a case in which the polarized electromagnet 4 and the movable contact support 37 of the contact mechanism 5 are linked by the drive lever 16*a* formed on the first armature 16. However, it is not limited to this, and a linking portion may be formed on the movable contact support 37, and the linking portion linked to the first armature 16.

Also, in the heretofore described embodiment, a description is given of a case in which the movable contact portion 35 has two normally open contacts and normally closed contacts. However, it is not limited to this, and it is possible to adopt a three phase, four line type of R-phase, S-phase, T-phase, or N-phase contact configuration, or another optional contact configuration.

Furthermore, in the heretofore described embodiment, a description is given of a case in which the spool 11 is configured of the cylindrical portion 12 and left and right flange portions 13 and 14, and the ring-like projection 13*c* and lattice-form projection 13*d* are formed on the coil retainer plate portion 13*a* of the left flange portion 13, but the ring-like projection 13*c* and lattice-form projection 13*d* may be omitted, and a non-magnetic body is inserted between the second armature 17 and interior yoke 22.

INDUSTRIAL APPLICABILITY

According to the invention, it is possible to provide a polarized electromagnet wherein the actually opposing portions in an interior yoke and an exterior yoke are only an end plate portion of the exterior yoke and second opposing portion of the interior yoke, which affect suction force, and it is possible to prevent leakage magnetic flux, and increase the suction force.

DESCRIPTION OF REFERENCE NUMERALS AND SIGNS

1 . . . electromagnet contactor, 2 . . . lower case, 3 . . . upper case, 4 . . . polarized electromagnet, 5 . . . contact mechanism, 10 . . . exciting coil, 11 . . . spool, 13 . . . left flange portion, 13*a* . . . coil retainer plate portion, 13*b* . . . armature housing portion, 13*e* . . . yoke holding portion, 14 right flange portion, 14*a* . . . coil retainer plate portion, 14*b* . . . armature housing portion, 14*c* . . . yoke holding portion, 14*d*, 14*e* . . . coil terminal portion, 15 . . . plunger, 16 . . . first armature, 16*a* . . . drive lever, 17 second armature, 18 . . . non-magnetic plate, 21 . . . exterior yoke, 21*a* . . . left end plate portion, 21*b* . . . right end plate portion, 21*c* linking plate portion, 21*d* flat plate portion, 21*e* . . . inclined plate portion, 22 . . . interior yoke, 22*a* . . . first opposing plate portion, 22*b* . . . bent portion, 22*c*, 22*d* . . . second opposing plate portion, 24 . . . permanent magnet, 32 . . . movable contact housing portion, 33 . . . main circuit terminal portion, 35 . . . movable contact portion, 37 . . . movable contact support, 41*a* . . . first opposing plate portion, 41*b*, 41*c* . . . second opposing plate portion.

What is claimed is:

1. A polarized electromagnet comprising:

a spool around which an exciting coil is wound; a movable plunger penetrating the spool; an interior yoke fixed on an outer side of the spool; an exterior yoke disposed to maintain a predetermined interval on an outer side of the interior yoke; and a permanent magnet disposed between the interior yoke and exterior yoke;

wherein the exterior yoke has a pair of end plate portions opposing two ends of the spool, and a linking plate portion linking the pair of end plate portions; and the interior yoke has a first opposing plate portion opposing the linking plate portion of the exterior yoke, and second opposing plate portions opposing one end plate portion of the exterior yoke, and the first opposing plate portion and the second opposing plate portion are linked without coming close to the exterior yoke.

2. A polarized electromagnet according to claim 1, wherein in the interior yoke, the first opposing plate portion and the second opposing plate portions are linked by a pair of upper and lower bent portions bending upper and lower end portions of the first opposing plate portion toward an exciting coil side.

3. A polarized electromagnet according to claim 2, wherein a size between outer sides of the bent portions is set to be equal to or less than a diameter of the exciting coil.

4. A polarized electromagnet according to claim 1, wherein the permanent magnet is disposed between the linking plate portion of the exterior yoke and the first opposing plate portion of the interior yoke.

5. A polarized electromagnet according to claim 1, wherein the interior yoke is arranged such that the second opposing plate portions are inserted and fixed in an insertion and holding portion formed on the spool.

6. A polarized electromagnet according to claim 1, wherein the spool is formed of a non-magnetic body, and has a cylindrical portion which the plunger is inserted through, and rectangular flange portions sandwiching two ends of the exciting coil formed at two ends of the cylindrical portion, a flange portion of the rectangular flange portions in which the interior yoke is inserted and held is configured of a coil retainer plate portion that contacts with one end portion of the exciting coil, and a frame-like armature housing portion attached to the coil retainer plate portion in a central portion on each side that houses an armature by opening an end portion linked to one end portion of the plunger, and a projection for positioning the armature is provided in a position opposing the armature of the armature housing portion.

* * * * *

UNITED STATES PATENT AND TRADEMARK OFFICE

CERTIFICATE OF CORRECTION

PATENT NO. : 8,466,761 B2
APPLICATION NO. : 13/138303
DATED : June 18, 2013
INVENTOR(S) : Yasuhiro Naka et al.

It is certified that error appears in the above-identified patent and that said Letters Patent is hereby corrected as shown below:

On the title page, Item (75), in Inventors,
Please change fourth inventor, "Kouetsu Takaya, Kounsou (JP)" to
--Kouetsu Takaya, Kounosu (JP)--.

In Specification,
Please change Column 2, line 52, "endplate" to --end plate--.

Please change Column 8, line 43, "armature comes into" to --armature 17 comes into--.

Please change Column 8, line 59, "endplate" to --end plate--.

Please change Column 9, line 40, "14 right flange portion," to --14...right flange portion,--.

Please change Column 9, line 44, "17 second armature," to --17...second armature--.

Please change Column 9, line 46, "21c linking plate portion," to --21c... linking plate portion,--.

Please change Column 9, line 46 to 47, "21d flat plate portion," to --21d...flat plate portion,--.

Signed and Sealed this
Seventeenth Day of September, 2013

Teresa Stanek Rea

Teresa Stanek Rea
*Deputy Director of the United States Patent and Trademark Office*